US008398275B2

(12) United States Patent
Wang et al.

(10) Patent No.: US 8,398,275 B2
(45) Date of Patent: Mar. 19, 2013

(54) LAMP HEAD ASSEMBLY AND LIGHTING LAMP TUBE

(75) Inventors: Bily Wang, Hsinchu (TW); Chi-Tseng Chang, Taoyuan County (TW); Chi-Kang Lo, Hsinchu (TW); Zhen-Hao Fan, Hsinchu County (TW)

(73) Assignee: Harvatek Corporation, Hsinchu (TW)

( * ) Notice: Subject to any disclaimer, the term of this patent is extended or adjusted under 35 U.S.C. 154(b) by 250 days.

(21) Appl. No.: 12/987,291

(22) Filed: Jan. 10, 2011

(65) Prior Publication Data

US 2012/0069583 A1 Mar. 22, 2012

(30) Foreign Application Priority Data

Sep. 21, 2010 (TW) ..... 99132047 A

(51) Int. Cl.
*F21V 19/02* (2006.01)

(52) U.S. Cl. ..... 362/372; 362/362; 362/370

(58) Field of Classification Search ..... 362/362–375
See application file for complete search history.

(56) References Cited

U.S. PATENT DOCUMENTS

| | | | | |
|---|---|---|---|---|
| 6,609,813 | B1 * | 8/2003 | Showers et al. | 362/240 |
| 2011/0194296 | A1 * | 8/2011 | Chou | 362/362 |
| 2011/0317435 | A1 * | 12/2011 | Wang | 362/370 |

* cited by examiner

*Primary Examiner* — Anne Hines
(74) *Attorney, Agent, or Firm* — Rosenberg, Klein & Lee

(57) ABSTRACT

A lamp head assembly includes an outer head unit, an inner head unit, and an elastic pressing unit. The outer head unit includes at least two conductive pins. The inner head unit is disposed rotatably in the outer head unit. The elastic pressing unit is disposed movably in the outer head unit for selectively positioning the position of the inner head unit relative to the outer head unit or the position of the outer head unit relative to the inner head unit, wherein the elastic pressing unit includes a pressing element selectively exposed from the outer head unit.

20 Claims, 8 Drawing Sheets

LAMP HEAD ASSEMBLY AND LIGHTING LAMP TUBE

BACKGROUND OF THE INVENTION

1. Field of the Invention

The instant disclosure relates to a lamp head assembly and a lighting lamp tube, and more particularly, to a lamp head assembly and a lighting lamp tube for adjusting light-projecting direction by rotation motion.

2. Description of Related Art

Traditional lighting devices such as lamps that adopt incandescent bulbs, fluorescent bulbs, or power-saving bulbs have been generally well-developed and used intensively indoor illumination. However, compared to the newly developed light-emitting-diode (LED) lamps, these traditional lamps have the disadvantages of quick attenuation, high power consumption, high heat generation, short working life, high fragility, and being not recyclable. Thus, various high-powered LED lamps are created to replace the traditional lighting devices. Among them, tubular LED lamps are gaining popularity for their dimensional resemblance of traditional fluorescent tubes and thus their adoptability to existing lighting devices.

However, conventional LED tubes suffer some drawbacks. For one thing, the LED units used in conventional tubular LED lamps are generally installed in groups on the same mounting surface of a substrate. Therefore, without a specially designed rotatable mechanism, upon installation onto the bracket of a lamp device, the light-projecting angle of the conventional LED tube is fixed and can not be adjusted. In other words, the electrode pins of the LED tube that electrically connect to the lamp bracket are fixed on two opposite ends of the LED tube, and thus when the electrode pins are inserted into the lamp bracket, the light beams generated by the LED tube is fixed and cannot be adjusted. Moreover, if the hosting bracket of the lamp device is of incorrect alignment with respect to the illumination angle of the LED tube, a conventional LED tube structure is unable to provide adjustability for proper correction. Therefore, the light-projecting angle of the prior art LED tubes cannot be corrected and cannot be adjusted according to the different requirements.

SUMMARY OF THE INVENTION

One particular aspect of the instant disclosure is to provide a lamp head assembly and a lighting lamp tube for adjusting light-projecting direction by rotation motion.

In order to achieve the above-mentioned advantages, the instant disclosure provides a lamp head assembly, comprising: an outer head unit, an inner head unit, and an elastic pressing unit. The outer head unit includes at least two conductive pins. The inner head unit is disposed rotatably in the outer head unit. The elastic pressing unit is disposed movably in the outer head unit for selectively positioning the position of the inner head unit relative to the outer head unit or the position of the outer head unit relative to the inner head unit, wherein the elastic pressing unit includes a pressing element selectively exposed from the outer head unit.

In order to achieve the above-mentioned advantages, the instant disclosure provides a lighting lamp tube, comprising: a lamp head assembly, an auxiliary lamp head assembly, a lamp assembly and a light-emitting assembly, and the lamp head assembly comprises an outer head unit, an elastic pressing unit and an inner head unit.

Therefore, the position of the inner head unit relative to the outer head unit or the position of the outer head unit relative to the inner head unit can be freely adjusted by selectively pressing, thus the light-projecting direction of the light-emitting assembly can be adjusted easily.

To further understand the techniques, means and effects the instant disclosure takes for achieving the prescribed objectives, the following detailed descriptions and appended drawings are hereby referred, such that, through which, the purposes, features and aspects of the instant disclosure can be thoroughly and concretely appreciated. However, the appended drawings are provided solely for reference and illustration, without any intention that they be used for limiting the instant disclosure.

DETAILED DESCRIPTION OF THE PREFERRED EMBODIMENTS

Figure 1A:
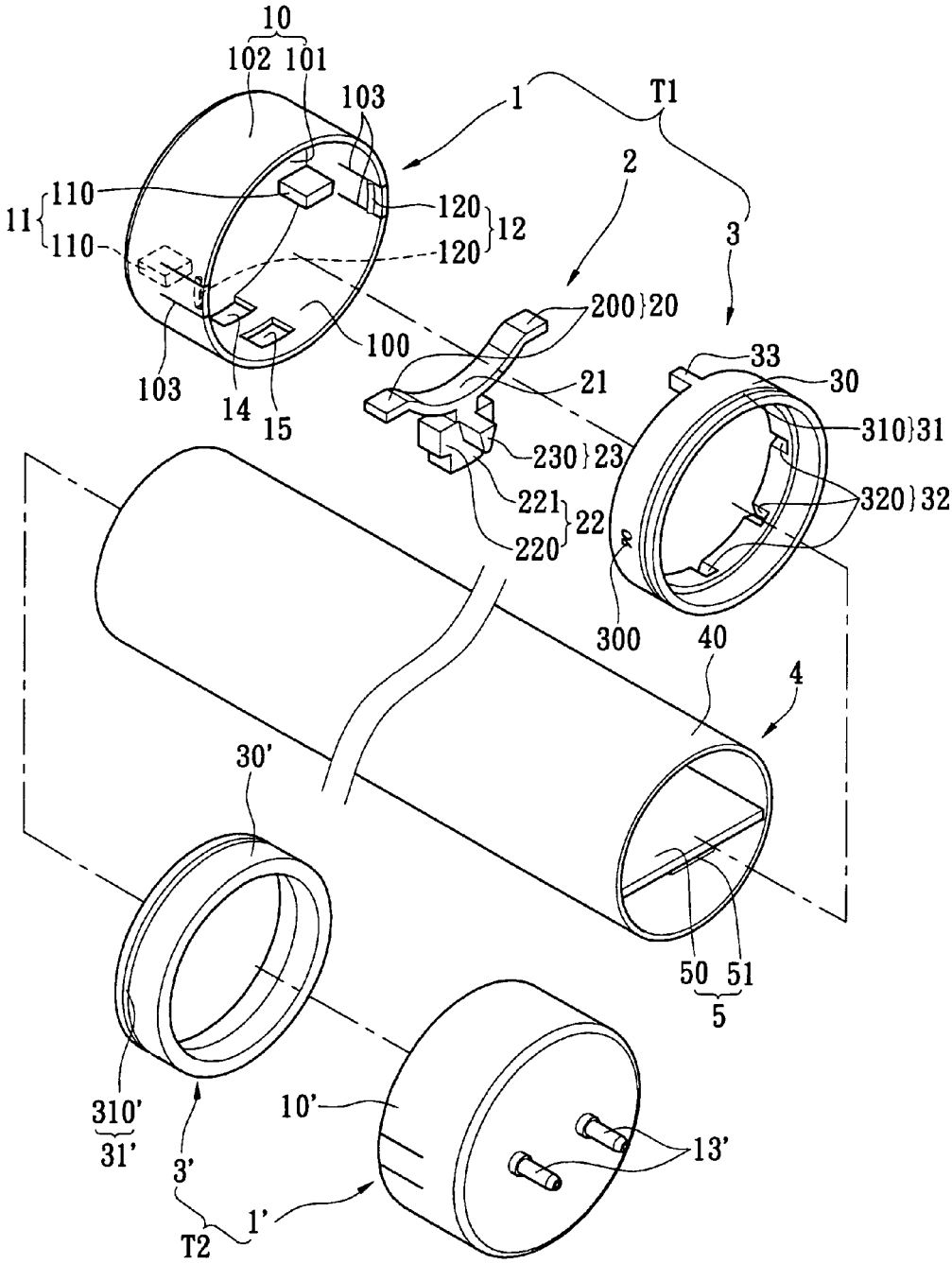
FIG. 1A shows one perspective, exploded, schematic view of the lighting lamp tube according to the first embodiment of the instant disclosure.

Referring to FIGS. 1A to 3, the first embodiment of the instant disclosure provides a lighting lamp tube for adjusting light-projecting direction by rotation motion, comprising: a lamp head assembly T1, an auxiliary lamp head assembly T2, a lamp assembly 4 and a light-emitting assembly 5, and the lamp head assembly T1 comprises an outer head unit 1, an elastic pressing unit 2 and an inner head unit 3.

The outer head unit 1 includes an outer head body 10, a first retaining structure 11 disposed on the inner surface of the outer head body 10, a first sliding structure 12 disposed on the inner surface of the outer head body 10, at least two conductive pins 13 passing through one side of the outer head body 10 and combined with the outer head body 10, and at least one button opening 14 passing through the outer head body 10. The outer head body 10 has a receiving groove 100. For example, the outer head body 10 has a lateral wall 101 and an annular wall 102 extended upwardly from a peripheral surface of the lateral wall 101, the two conductive pins 13 pass through the lateral wall 101 and combine with the lateral wall 101, the first retaining structure 11 and the first sliding structure 12 are disposed on the inner surface of the annular wall 102 (the first retaining structure 11 contacts the inner surface of the lateral wall 101 and the inner surface of the annular wall 102 at the same time), and the button opening 14 passes through the annular wall 102.

Figure 1B:
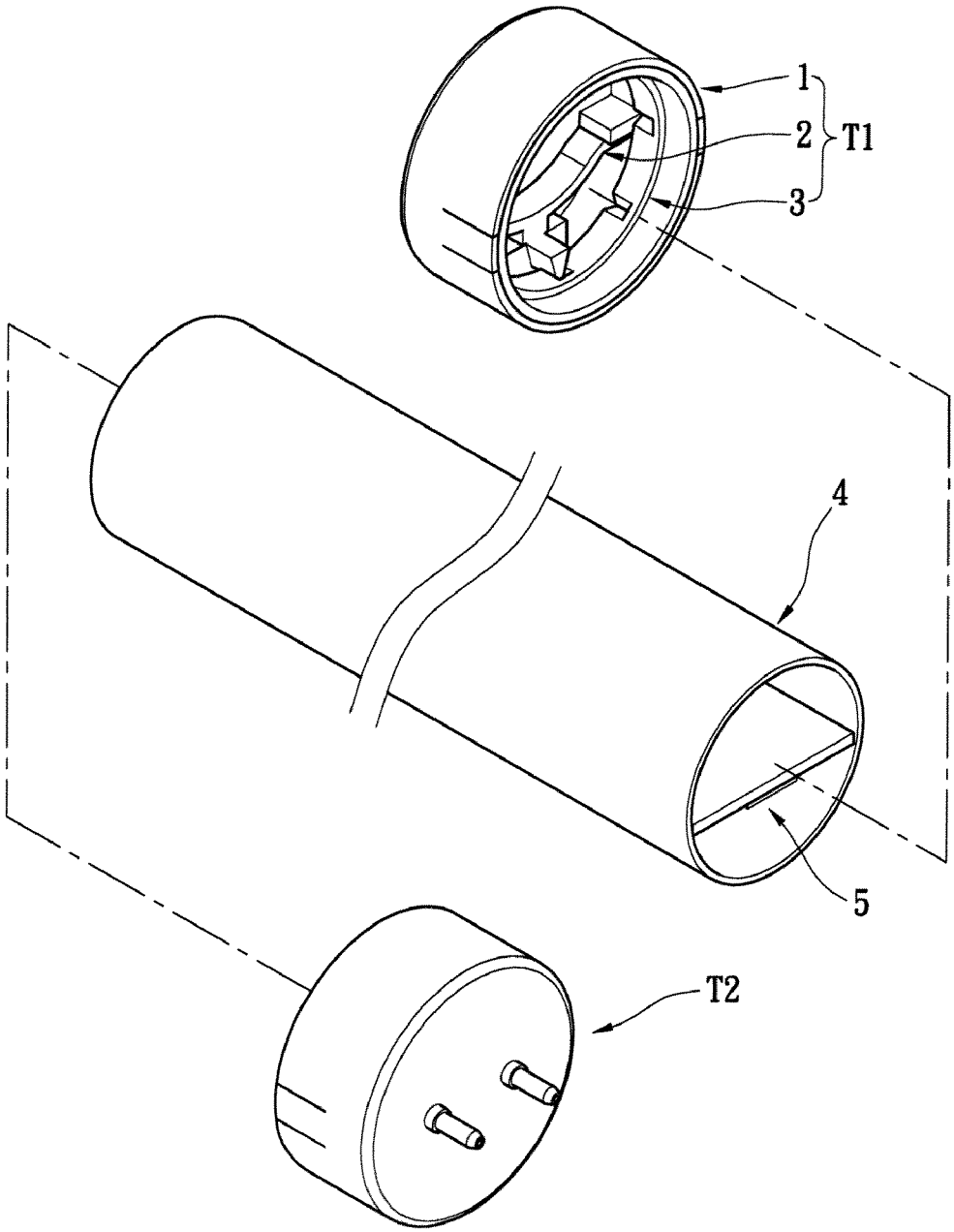
FIG. 1B shows one partial, assembled, schematic view of the lighting lamp tube according to the first embodiment of the instant disclosure.

The elastic pressing unit 2 is disposed movably in the receiving groove 100 of the outer head body 10 (as shown in FIGS. 1A and 1B). The elastic pressing unit 2 includes a second retaining structure 20 mated with the first retaining structure 11, an elastic element 21 extended downwardly from the second retaining structure 20, a pressing element 22 extended downwardly from the elastic element 21 and passing through the button opening 14, and a first positioning element 23 extended outwardly from a lateral side of the pressing element 22 along a direction toward the lamp assembly 4.

The inner head unit 3 is disposed rotatably in the receiving groove 100 of the outer head body 10 (as shown in FIGS. 1A and 1B) The inner head unit 3 includes a hollow inner head body 30, a second sliding structure 31 disposed on the outer surface of the inner head body 30 and mated with the first sliding structure 12, and a plurality of second positioning elements 32 disposed on the inner surface of the inner head body 30, and the first positioning element 23 is selectively mated with one of the second positioning elements 32.

The first embodiment of the instant disclosure has different features according to different requirements, as follows:

1. The first retaining structure 11 has at least two convex blocks 110 corresponding to each other and disposed on the inner surface of the outer head body 10, and the second retaining structure 20 has at least two contacting elements 200 respectively abutted against the two convex blocks 110. In other words, the elastic pressing unit 2 can be movably disposed between the two convex blocks 110 and the inner surface of the outer head body 10 through the elasticity of the elastic element 21.

2. The first sliding structure 12 has at least two sliding convex strips 120 corresponding to each other and projected outwardly from the inner surface of the outer head body 10, and the second sliding structure 31 has an annular groove 310 for receiving the two sliding convex strips 120. The two sliding convex strips 120 can be freely slid in the annular groove 310, thus the inner head body 30 can be rotated relative to the outer head body 10 or the outer head body 10 can be rotated relative to the inner head body 30.

3. The outer head unit 10 includes a plurality of slots 103 connected to an external lateral side of the outer head body 10 and passing through the outer head body 10, and each sliding convex strip 120 is connected between every two slots 103 or is close to at least one slot 103. In other words, each sliding convex strip 120 can be lightly pushed outwardly through the design of the slots 103, thus it is easy for user to retain the two sliding convex strips 120 in the annular groove 310 without using any auxiliary tool.

Figure 2A:
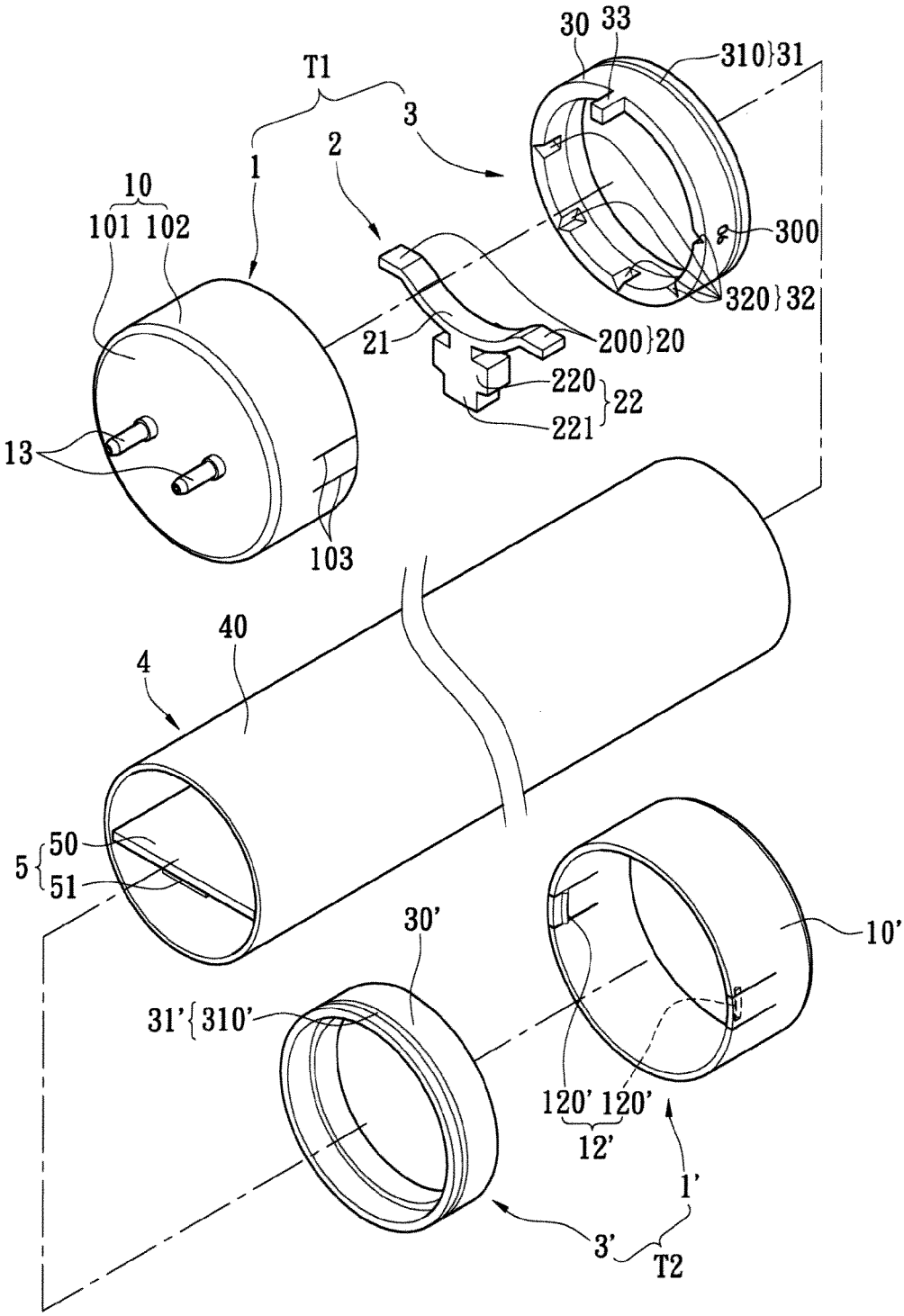
FIG. 2A shows another perspective, exploded, schematic view of the lighting lamp tube according to the first embodiment of the instant disclosure.
Figure 2B:
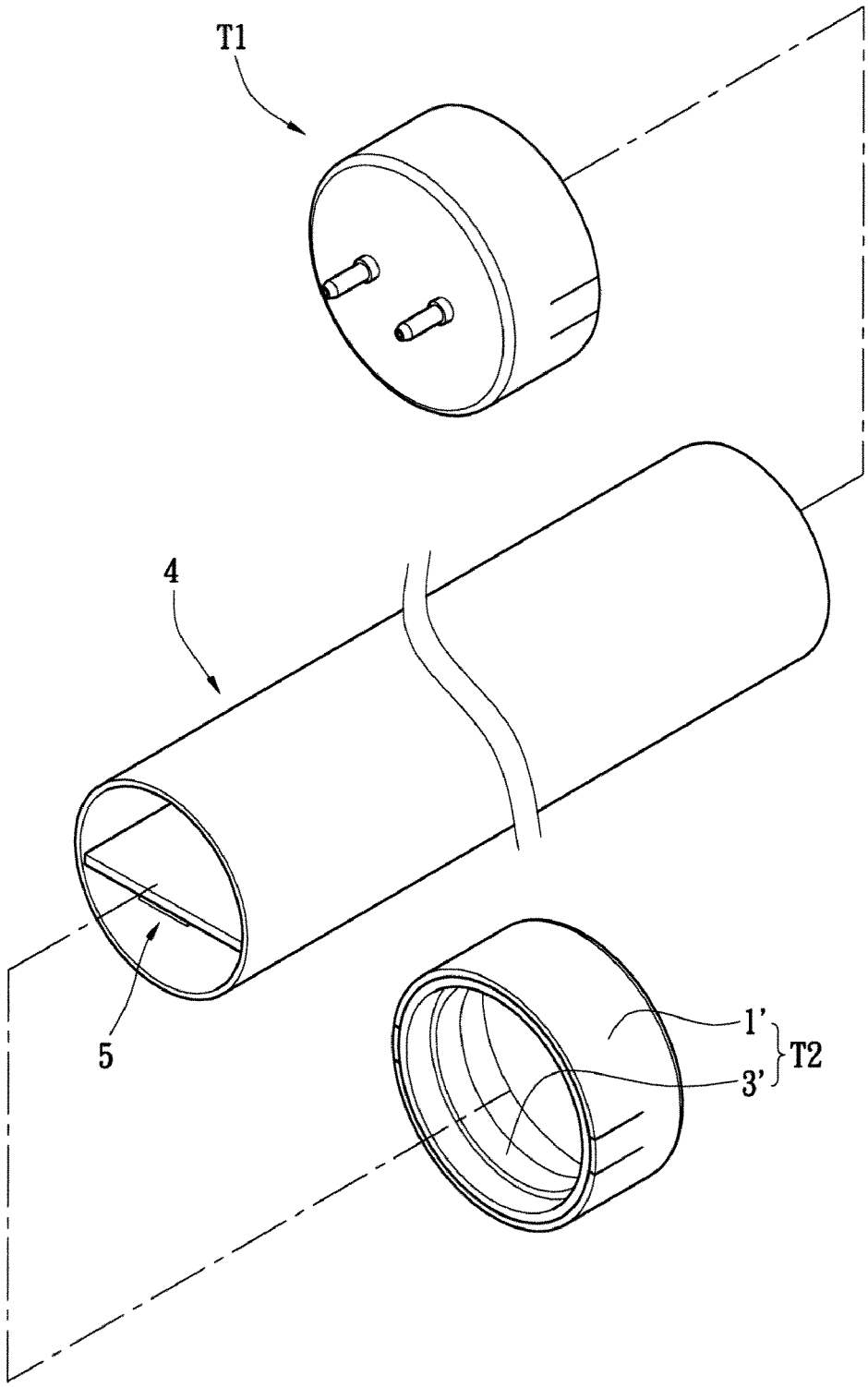
FIG. 2B shows another partial, assembled, schematic view of the lighting lamp tube according to the first embodiment of the instant disclosure.
Figure 3:
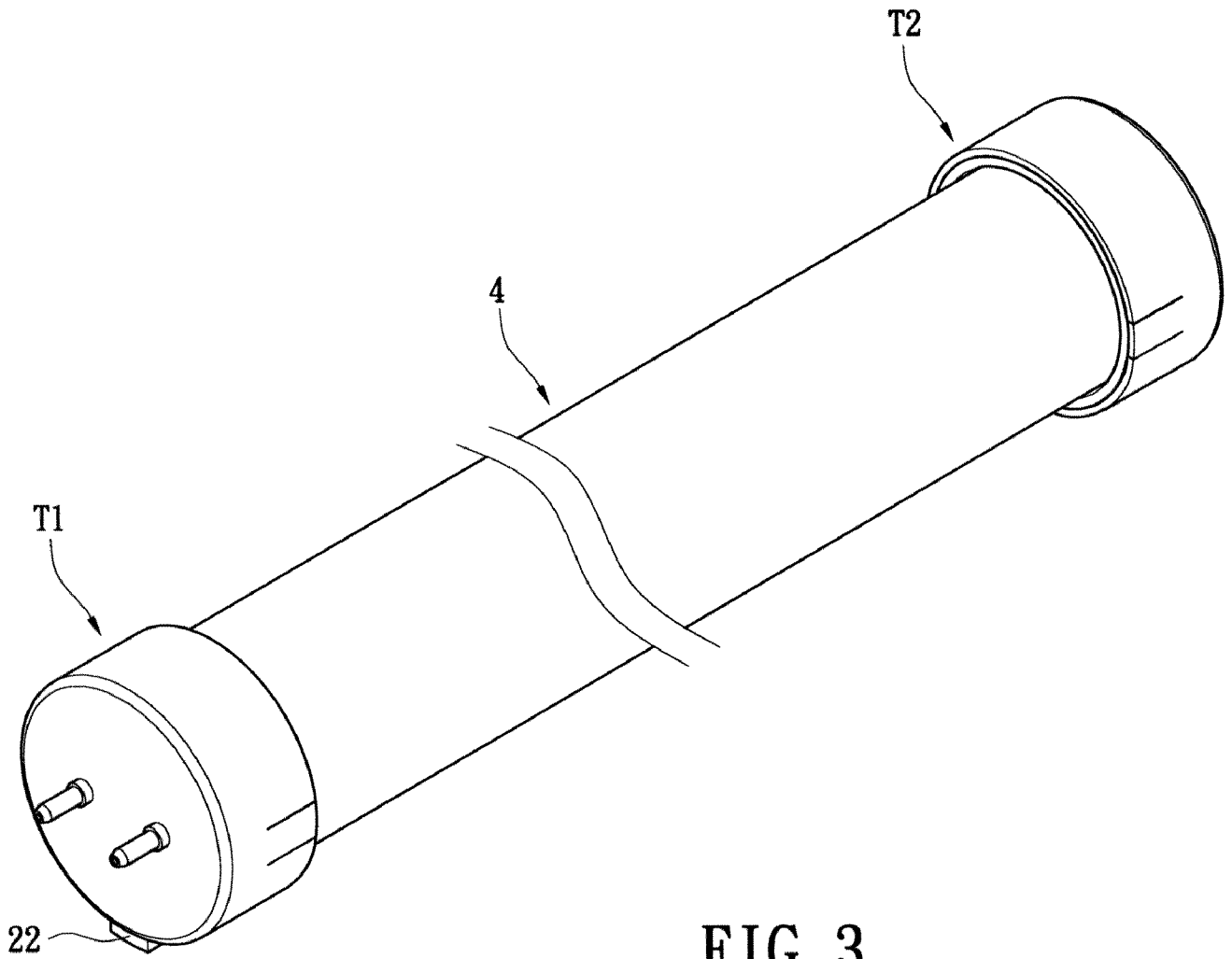
FIG. 3 shows a perspective, assembled, schematic view of the lighting lamp tube according to the first embodiment of the instant disclosure.

4. The outer head unit 1 includes at least one angle display opening 15 passing through the outer head body 10, the inner head unit 3 includes a plurality of rotation scales 300 disposed on the external surface of the inner head body 30 and respectively corresponding to the second positioning elements 32, and any one of the rotation scales 300 can be selectively exposed by the angle display opening 15. For example, there are a first position element 23 and five second position elements 32, the first position element 23 may be a V-shaped convex block 230, and each second position element may be a V-shaped groove 320 for receiving the V-shaped convex block 230. The V-shaped grooves 320 respectively correspond to the rotation scales 300 that have five labels such as 90°, 45°, 0°, 45°, 90°. Referring to FIG. 2A, two outmost rotation scales 300 are 90°, the bottommost rotation scale 300 is 0°, and the other rotation scales 300 are 45°.

5. The elastic element 21 may be a metal or plastic elastic piece, the pressing element 22 may be a T-type pressing element, and the pressing element 22 (the T-type pressing element) has a head portion 220 received in the receiving groove 100 and a button portion 221 extended downwardly from the head portion 220 and passing through the button opening 14. In other words, when the pressing element 22 is elastically pressed, the first position element 23 can be moved upwardly to separate from the second position element 32.

6. The inner head unit 3 includes at least one rotation angle limiting structure 33 extended from one lateral side of the inner head body 30 to the outer head body 10 for selectively contacting the first retaining structure 11. In other words, the inner head body 30 can be only rotated by a predetermined angle relative to the outer head body 10 by matching the rotation angle limiting structure 33 and the first retaining structure 11.

The auxiliary lamp head assembly T2 includes an auxiliary outer head unit 1' and an auxiliary inner head unit 3' disposed rotatably in the auxiliary outer head 1', and the auxiliary outer head unit 1' has at least two auxiliary conductive pins 13' that are the same as the two conductive pins 13. The auxiliary outer head unit 1' has a first sliding structure 12' disposed on the inner surface of the outer head body 10', and the first sliding structure 12' has at least two sliding convex strips 120' corresponding to each other and projected outwardly from the inner surface of the outer head body 10'. The auxiliary inner head unit 3' has a second sliding structure 31' disposed on the outer surface of the inner head body 30' and mated with the first sliding structure 12', and the second sliding structure 31' has an annular groove 310' for receiving the two sliding convex strips 120'. In other words, the two sliding convex strips 120' can be freely slid in the annular groove 310', thus the inner head body 30' can be rotated relative to the outer head body 10' or the outer head body 10' can be rotated relative to the inner head body 30'.

The lamp assembly 4 includes a hollow light-permitting tube 40 connected between the inner head body 30 of the inner head unit 3 and the inner head body 30' of the auxiliary inner head unit 3'. For example, the hollow light-permitting tube 40 may be a hollow transparent tube that may be made of plastic or glass material, and the hollow light-permitting tube 40 can be fixed between the inner head body 30 of the inner head unit 3 and the inner head body 30' of the auxiliary inner head unit 3' by any fixing method such as using adhesive.

The light-emitting assembly 5 is electrically connected between the lamp head assembly T1 and auxiliary lamp head assembly T2 and disposed inside the hollow light-permitting tube 40. For example, the light-emitting assembly 5 includes a substrate unit 50 received in the hollow light-permitting tube 40 and a light-emitting module 51 received in the hollow light-permitting tube 40 and electrically connected to the substrate unit 50, and the light-emitting module 51 may be a light-emitting strip composed of many LEDs.

Referring to FIGS. 4A to 4D, after user presses the pressing element 22 (shown as the direction of the upward arrow in FIG. 4B) to separate the first position element 23 (such as V-shaped concave block 230) from one of the second position elements 32 (such as V-shaped groove 320), the inner head body 30 can be rotated relative to the outer head body 10 or the outer head body 10 can be rotated relative to the inner head body 30.

Figure 4A:
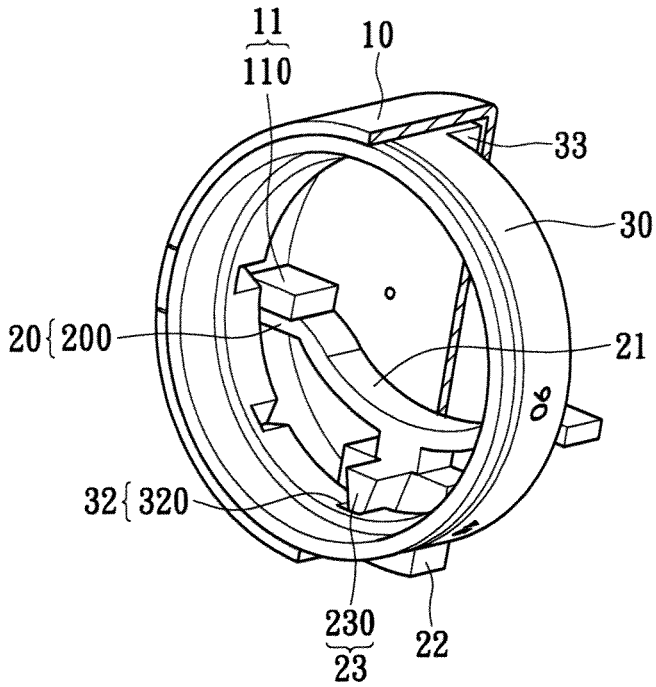
FIGS. 4A to 4D respectively show four perspective, schematic views for displaying a method for rotating the inner head body relative the outer head body according to the first embodiment of the instant disclosure.
Figure 4B:
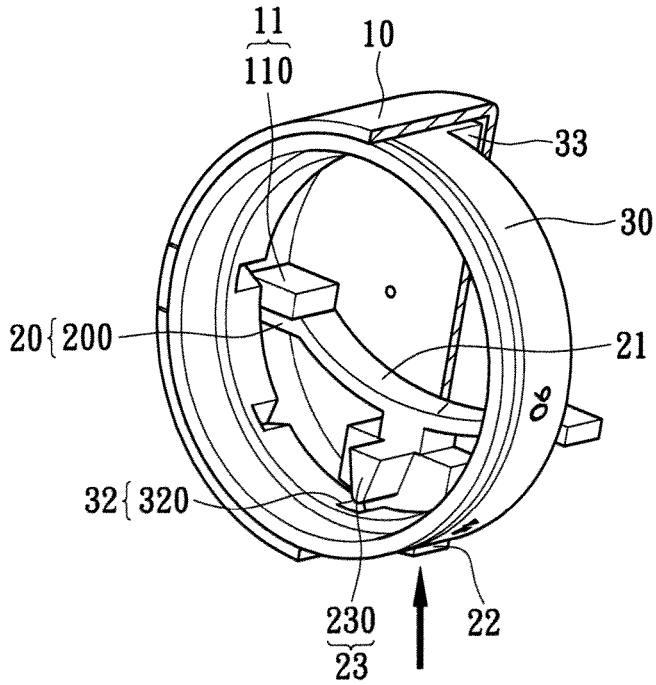
Figure 4C:
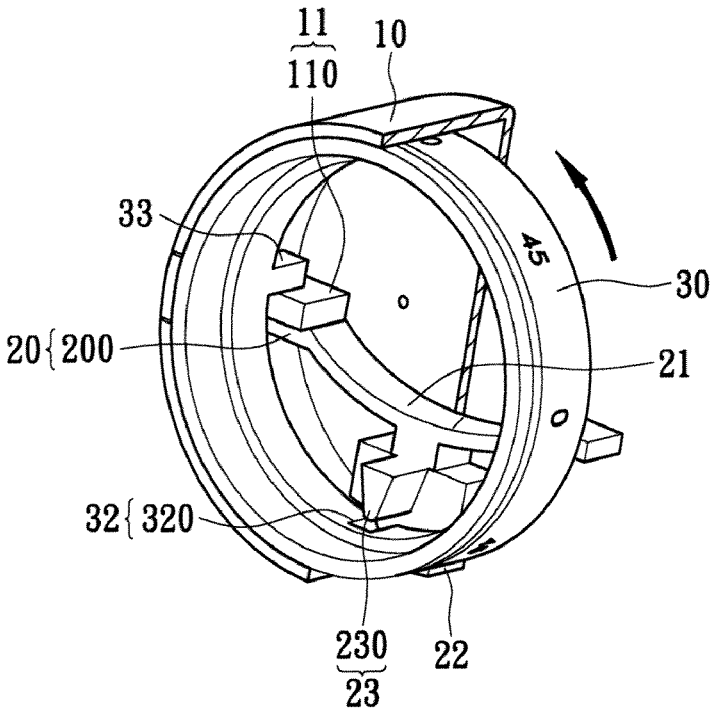
Figure 4D:
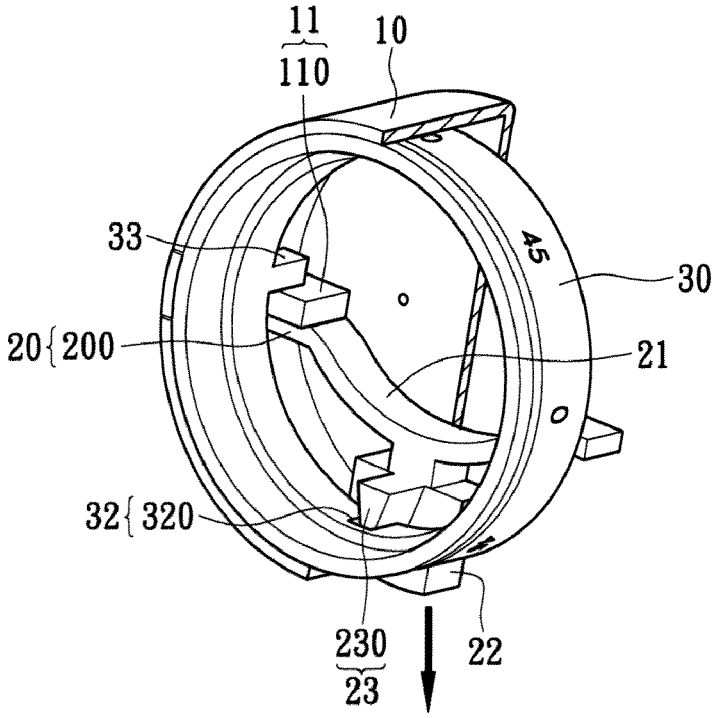

Referring to FIG. 4C, when the outer head body 10 is fixed (such as the two conductive pins 13 are inserted into two sockets of a lamp base (not shown), the inner head body 30 can be rotated by a predetermined angle relative to the outer head body 10 (shown as the clockwise arrow in FIG. 4C). When the inner head body 30 has been rotated by a predetermined angle (such as 90°) relative to the outer head body 10 and the first position element 23 (such as V-shaped concave block 230) corresponds to another second position element 32 (such as V-shaped groove 320) as shown in FIG. 4C, the user can release the pressing element 22 to insert the first position element 23 into another second position element 32 (shown as the direction of the arrow in FIG. 4D), thus the relative position between the inner head body 30 and the outer head body 10 is fixed.

Hence, the elastic pressing unit 2 is disposed movably in the outer head unit 10 for selectively positioning the position of the inner head unit 3 relative to the outer head unit 1 or the position of the outer head unit 1 relative to the inner head unit 3. In other words, the position of the inner head unit 3 relative to the outer head unit 1 or the position of the outer head unit 1 relative to the inner head unit 3 can be freely adjusted by selectively pressing the first position element 23 of the elastic pressing unit 2, thus the inner socket unit 30, the hollow light-transmitting tube 40 and the light-emitting assembly 5 can be rotated together to easily adjust the light-projecting direction of the light-emitting assembly 5. Hence, the purpose of adjusting light-projecting direction by rotation motion can be achieved easily.

Figure 5:
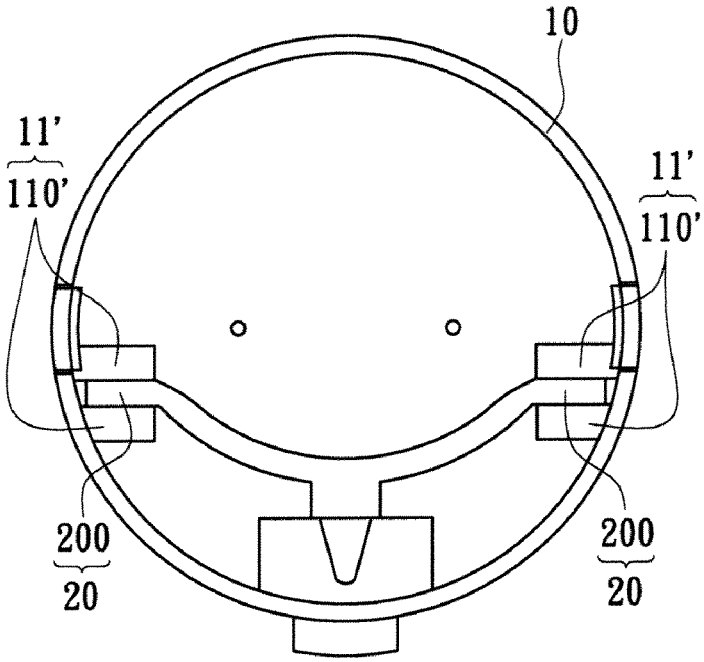
FIG. 5 shows a lateral, schematic view of the elastic pressing unit mated with the outer head unit according to the second embodiment of the instant disclosure.

Referring to FIG. 5, the difference between the second embodiment and the first embodiment is that: in the second embodiment, the first retaining structure 11' has at least two retaining grooves 110' corresponding to each other and disposed on the inner surface of the outer head body 10, and the second retaining structure 20 has at least two retaining blocks 200 respectively retained in the two retaining grooves 110'.

Figure 6:
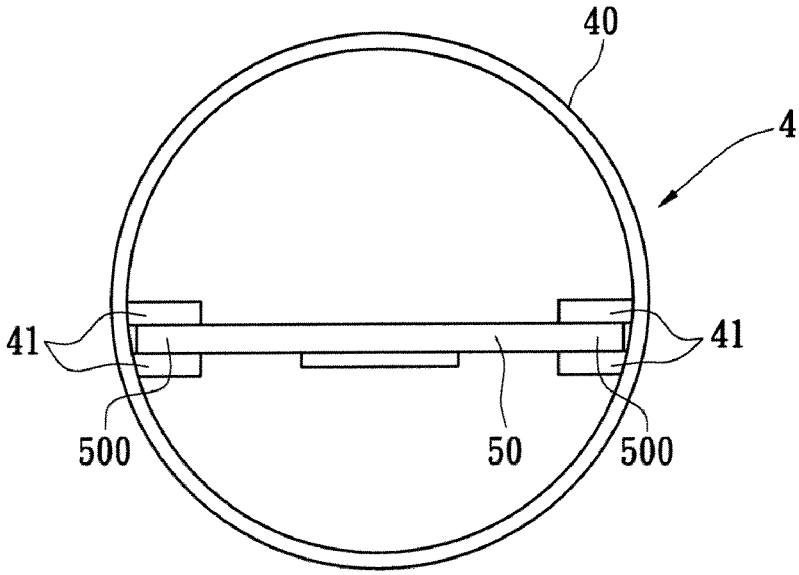
FIG. 6 shows a lateral, schematic view of the light-emitting assembly mated with the lamp assembly according to the third embodiment of the instant disclosure.

Referring to FIG. 6, the difference between the third embodiment and the first embodiment is that: in the third embodiment, the lamp assembly 4 includes at least two retaining structures 41 disposed on the inner surface of the hollow transparent tube 40, and the two opposite lateral side portions 500 of the substrate unit 50 can be respectively retained in the two retaining structures 41, thus the substrate unit 50 can be positioned between the two retaining structures 41.

The above-mentioned descriptions merely represent the preferred embodiments of the instant disclosure, without any intention or ability to limit the scope of the instant disclosure which is fully described only within the following claims. Various equivalent changes, alterations or modifications based on the claims of instant disclosure are all, consequently, viewed as being embraced by the scope of the instant disclosure.

What is claimed is:

1. A lamp head assembly, comprising:

an outer head unit including an outer head body, a first retaining structure disposed on the inner surface of the outer head body, a first sliding structure disposed on the inner surface of the outer head body, at least two conductive pins passing through one side of the outer head body and combined with the outer head body, and at least one button opening passing through the outer head body, wherein the outer head body has a receiving groove;

an elastic pressing unit disposed movably in the receiving groove of the outer head body, wherein the elastic pressing unit includes a second retaining structure mated with the first retaining structure, an elastic element extended downwardly from the second retaining structure, a pressing element extended downwardly from the elastic element and passing through the button opening, and a first positioning element extended outwardly from a lateral side of the pressing element; and an inner head unit disposed rotatably in the receiving groove of the outer head body, wherein the inner head unit includes a hollow inner head body, a second sliding structure disposed on the outer surface of the inner head body and mated with the first sliding structure, and a plurality of second positioning elements disposed on the inner surface of the inner head body, and the first positioning element is selectively mated with one of the second positioning elements.

2. The lamp head assembly as claimed in claim 1, wherein the outer head body has a lateral wall and an annular wall extended upwardly from a peripheral surface of the lateral wall, the two conductive pins pass through the lateral wall and combine with the lateral wall, the first retaining structure and the first sliding structure are disposed on the inner surface of the annular wall, and the button opening passes through the annular wall.

3. The lamp head assembly as claimed in claim 1, wherein the first retaining structure has at least two convex blocks corresponding to each other and disposed on the inner surface of the outer head body, and the second retaining structure has at least two contacting elements respectively abutted against the two convex blocks.

4. The lamp head assembly as claimed in claim 1, wherein the first retaining structure has at least two retaining grooves corresponding to each other and disposed on the inner surface of the outer head body, and the second retaining structure has at least two retaining blocks respectively retained in the two retaining grooves.

5. The lamp head assembly as claimed in claim 1, wherein the first sliding structure has at least two sliding convex strips corresponding to each other and projected outwardly from the inner surface of the outer head body, and the second sliding structure has an annular groove for receiving the two sliding convex strips.

6. The lamp head assembly as claimed in claim 5, wherein the outer head unit includes a plurality of slots connected to an external lateral side of the outer head body and passing through the outer head body, and each sliding convex strip is connected between every two slots.

7. The lamp head assembly as claimed in claim 1, wherein the outer head unit includes at least one angle display opening passing through the outer head body, the inner head unit includes a plurality of rotation scales disposed on the external surface of the inner head body and respectively corresponding to the second positioning elements, and any one of the rotation scales is selectively exposed by the angle display opening.

8. The lamp head assembly as claimed in claim 1, wherein the elastic element is a metal or plastic elastic piece, the pressing element is a T-type pressing element, and the T-type pressing element has a head portion received in the receiving groove and a button portion extended downwardly from the head portion and passing through the button opening.

9. The lamp head assembly as claimed in claim 1, wherein the inner head unit includes at least one rotation angle limiting structure extended from one lateral side of the inner head body to the outer head body for selectively contacting the first retaining structure.

10. A lamp head assembly, comprising:

an outer head unit including at least two conductive pins;

an inner head unit disposed rotatably in the outer head unit; and an elastic pressing unit disposed movably in the outer head unit for selectively positioning the position of the inner head unit relative to the outer head unit or the position of the outer head unit relative to the inner head unit, wherein the elastic pressing unit includes a pressing element selectively exposed from the outer head unit.

11. A lighting lamp tube, comprising:

a lamp head assembly comprising an outer head unit, an elastic pressing unit and an inner head unit, wherein the outer head unit includes an outer head body, a first retaining structure disposed on the inner surface of the outer head body, a first sliding structure disposed on the inner surface of the outer head body, at least two conductive pins passing through one side of the outer head body and combined with the outer head body, and at least one button opening passing through the outer head body, wherein the outer head body has a receiving groove, wherein the elastic pressing unit is disposed movably in the receiving groove of the outer head body, wherein the elastic pressing unit includes a second retaining structure mated with the first retaining structure, an elastic element extended downwardly from the second retaining structure, a pressing element extended downwardly from the elastic element and passing through the button opening, and a first positioning element extended outwardly from a lateral side of the pressing element, wherein the inner head unit is disposed rotatably in the receiving groove of the outer head body, wherein the inner head unit includes a hollow inner head body, a second sliding structure disposed on the outer surface of the inner head body and mated with the first sliding structure, and a plurality of second positioning elements disposed on the inner surface of the inner head body, and the first positioning element is selectively mated with one of the second positioning elements;

an auxiliary lamp head assembly including an auxiliary outer head unit and an auxiliary inner head unit disposed rotatably in the auxiliary outer head, wherein the auxiliary outer head unit has at least two auxiliary conductive pins;

a lamp assembly including a hollow light-permitting tube connected between the inner head body of the inner head unit and the auxiliary inner head unit; and a light-emitting assembly electrically connected between the lamp head assembly and auxiliary lamp head assembly and disposed inside the hollow light-permitting tube.

12. The lighting lamp tube as claimed in claim 11, wherein the outer head body has a lateral wall and an annular wall extended upwardly from a peripheral surface of the lateral wall, the two conductive pins pass through the lateral wall and combine with the lateral wall, the first retaining structure and the first sliding structure are disposed on the inner surface of the annular wall, and the button opening passes through the annular wall.

13. The lighting lamp tube as claimed in claim 11, wherein the first retaining structure has at least two convex blocks corresponding to each other and disposed on the inner surface of the outer head body, and the second retaining structure has at least two contacting elements respectively abutted against the two convex blocks.

14. The lighting lamp tube as claimed in claim 11, wherein the first retaining structure has at least two retaining grooves corresponding to each other and disposed on the inner surface of the outer head body, and the second retaining structure has at least two retaining blocks respectively retained in the two retaining grooves.

15. The lighting lamp tube as claimed in claim 11, wherein the first sliding structure has at least two sliding convex strips corresponding to each other and projected outwardly from the inner surface of the outer head body, and the second sliding structure has an annular groove for receiving the two sliding convex strips.

16. The lighting lamp tube as claimed in claim 15, wherein the outer head unit includes a plurality of slots connected to an external lateral side of the outer head body and passing through the outer head body, and each sliding convex strip is connected between every two slots.

17. The lighting lamp tube as claimed in claim 11, wherein the outer head unit includes at least one angle display opening passing through the outer head body, the inner head unit includes a plurality of rotation scales disposed on the external surface of the inner head body and respectively corresponding to the second positioning elements, and any one of the rotation scales is selectively exposed by the angle display opening.

18. The lighting lamp tube as claimed in claim 11, wherein the elastic element is a metal or plastic elastic piece, the pressing element is a T-type pressing element, and the T-type pressing element has a head portion received in the receiving groove and a button portion extended downwardly from the head portion and passing through the button opening.

19. The lighting lamp tube as claimed in claim 11, wherein the inner head unit includes at least one rotation angle limiting structure extended from one lateral side of the inner head body to the outer head body for selectively contacting the first retaining structure.

20. A lighting lamp tube, comprising:

a lamp head assembly comprising an outer head unit, an inner head unit and an elastic pressing unit, wherein the outer head unit includes at least two conductive pins, the inner head unit is disposed rotatably in the outer head unit, the elastic pressing unit is disposed movably in the outer head unit for selectively positioning the position of the inner head unit relative to the outer head unit or the position of the outer head unit relative to the inner head unit, wherein the elastic pressing unit includes a pressing element selectively exposed from the outer head unit;

an auxiliary lamp head assembly including an auxiliary outer head unit and an auxiliary inner head unit disposed rotatably in the auxiliary outer head, wherein the auxiliary outer head unit has at least two auxiliary conductive pins;

a lamp assembly including a hollow light-permitting tube connected between the inner head unit and the auxiliary inner head unit; and a light-emitting assembly electrically connected between the lamp head assembly and auxiliary lamp head assembly and disposed inside the hollow light-permitting tube.

* * * * *